US010358827B1

(12) United States Patent
Sorenson, Jr.

(10) Patent No.: US 10,358,827 B1
(45) Date of Patent: Jul. 23, 2019

(54) SYSTEM AND METHOD FOR STAIR ASSEMBLY AND INSTALLATION

(71) Applicant: Robert Everett Sorenson, Jr., Tiburon, CA (US)

(72) Inventor: Robert Everett Sorenson, Jr., Tiburon, CA (US)

( * ) Notice: Subject to any disclaimer, the term of this patent is extended or adjusted under 35 U.S.C. 154(b) by 0 days.

(21) Appl. No.: 16/034,295

(22) Filed: Jul. 12, 2018

Related U.S. Application Data

(63) Continuation of application No. 15/375,130, filed on Dec. 11, 2016, now abandoned.

(51) Int. Cl.
*E04F 11/028* (2006.01)
*E04F 11/02* (2006.01)

(52) U.S. Cl.
CPC ..... *E04F 11/028* (2013.01); *E04F 11/02* (2013.01); *E04F 2011/0203* (2013.01)

(58) Field of Classification Search
CPC .. E04F 11/028; E04F 11/02; E04F 2011/0203
See application file for complete search history.

(56) References Cited

U.S. PATENT DOCUMENTS 1,166,428 A 1/1916 Brooks
2,377,994 A 12/1942 Cocken, Jr.
2,899,011 A 8/1956 Babits
3,914,912 A 10/1975 Rosenberg
3,914,914 A 10/1975 Juriet et al.
4,034,525 A 7/1977 Yokomori
5,349,795 A 9/1994 French et al.
5,636,483 A 6/1997 Wille
5,890,330 A 4/1999 Lesage
6,568,145 B2 5/2003 Bartel
6,905,110 B2 6/2005 Brown
8,910,434 B2 * 12/2014 Zirbel ..... B28B 7/225 52/182
2017/0239838 A1 * 8/2017 Eggleston, II ..... B28B 7/225

* cited by examiner

*Primary Examiner* — Joshua K Ihezie
(74) *Attorney, Agent, or Firm* — John D. Gugliotta

(57) ABSTRACT

A manufacturing system provides for building staircase assemblies of different design criteria and different building codes. The assemblies are manufactured in an assembly-line manner from one or more centralized manufacturing facilities. Individual projects are shipped to different job sites. The assembly is formed in an off-site, manufacturing facility. The completed assembly obtains a certification to indicate successful building code compliance for the final jurisdiction. The completed stair assembly is disassembled, packaged and shipped to the final building construction site where the assembly can be reassembled and installed. Final installation adjustments, as needed, can accommodate height, width or length adjustments needed to overcome manufacturing tolerances between the assembly and its stairwell. The instant abstract is neither intended to define the invention disclosed in this specification nor intended to limit the scope of the invention in any way.

9 Claims, 11 Drawing Sheets

SYSTEM AND METHOD FOR STAIR ASSEMBLY AND INSTALLATION

RELATED APPLICATIONS

The present application is a Continuation in Part of U.S. Ser. No. 15/375,130, filed on Dec. 11, 2016 and incorporated by reference as if fully rewritten herein.

BACKGROUND OF THE INVENTION

1. Field of the Invention

This invention generally relates to a staircase system, more specifically to an adjustable staircase system and, still more precisely to a staircase system that can be expanded to a desired width that is easily and quickly built, cost effective and is safe to be installed by an average worker.

2. Description of the Related Art

A major cost portion of any construction project, whether residential, commercial, or industrial, is that of stair construction. The specialized nature of stair construction, coupled with the multitude of individual pieces that may fit exactly, various building codes that may be met and the various materials that can be used, make it necessary to use highly skilled craftsmen to design and construct stairs. These craftsmen are necessary whether building one stair or multiple stairs of the same design, because of the small variations between floor heights, and floors may lead to a not so perfectly level or square.

Accordingly, the need has arisen for development of a stair system which provides the ability to reduce material and labor cost by being pre-manufactured off-site but still having the flexibility of height and length to allow for on-site installation.

A search of the prior art did not disclose any patents that read directly on the claims of the instant invention; however some other related works are either expensive or cumbersome for assembly and require highly skilled craftsmen to design and construct stairs and thus they are time consuming in construction and increasing the labor cost as well. Consequently, a need exists for a providing a system and method for the manufacturing of code-compliant staircase system which can be assembled and adjusted for installation quickly by an average worker.

SUMMARY OF THE INVENTION

In view of the foregoing disadvantages inherent in the above-mentioned techniques, a general object of the present invention is to obviate above and other drawbacks associated with the prior art.

The object of the invention is to provide a system and method of manufacturing and installing staircases.

It is a further object of the present invention to staircase system made therefrom that can be modularly manufactured off-site.

It is another object of the present invention to provide such a modularly manufacture staircase that can be adjustable installed on-site.

It is yet another object of the present invention to make such staircases building code compliant.

Briefly described according to a preferred embodiment of the present invention, a distributed manufacturing system may be provided in which building code requirements from multiple jurisdictions to a computer server 202 over a distributed network. The server may store various building codes in a database, and a selected building code requirement for a selected staircase assembly project is provided to an off-site manufacturing facility. Different design criteria and different building codes may be met for specific stair assemblies that are manufactured in an assembly-line manner. From one or more centralized manufacturing facilities, individual projects may be shipped to different job sites.

According to another aspect of the present invention, a method for creation and installation of a stair assembly provides for the identification of a plurality of building code requirements from differing jurisdictions. Upon identification of the jurisdiction where the installation will occur, the proper building code will be identified. A modular stair assembly will thereby be formed in an off-site, manufacturing facility in a modularly constructed manner. The completed assembly will obtain a certificate of compliance or similar certification to indicate a successful building code compliance for the identified jurisdiction. The completed stair assembly will thereby be disassembled and packaged, as necessary, and shipped to the final building construction site where the assembly can be reassembled and installed. Final installation adjustments, as needed, can accommodate height, width or length adjustments needed to overcome manufacturing tolerances between the assembly and its stairwell.

According to the above system and method, a user may obtain building code certification for the selected jurisdiction where final permanent construction will occur. At the permanent construction site, the modular stair assembly may be formed or installed in a manner that meets both the needed design criteria and the necessary building code requirements.

In the reassembly of any modular sections of the stair assembly at a specific stair assembly location, the assembly may be placed within a specific stairwell envelope and installed by laterally extending the at least one outer stair element to comport with a final fitment before permanently securing the stair assembly.

The invention described herein is not limited to the above description, any other embodiment implementing the concept of instant invention will fall under the scope of the present invention and will be the subject matter of the protection.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

A further understanding of the present invention may be obtained with reference to the following description taken in conjunction with the accompanying drawings. However, the embodiments used for describing the invention are illustrative only and no way limiting scope of the invention. A person skilled in the art will appreciate that many more embodiments of the invention are possible without deviating from the basic concept of the invention any such embodiments will fall under the scope of the invention and is a subject matter of protection.

Figure 1:
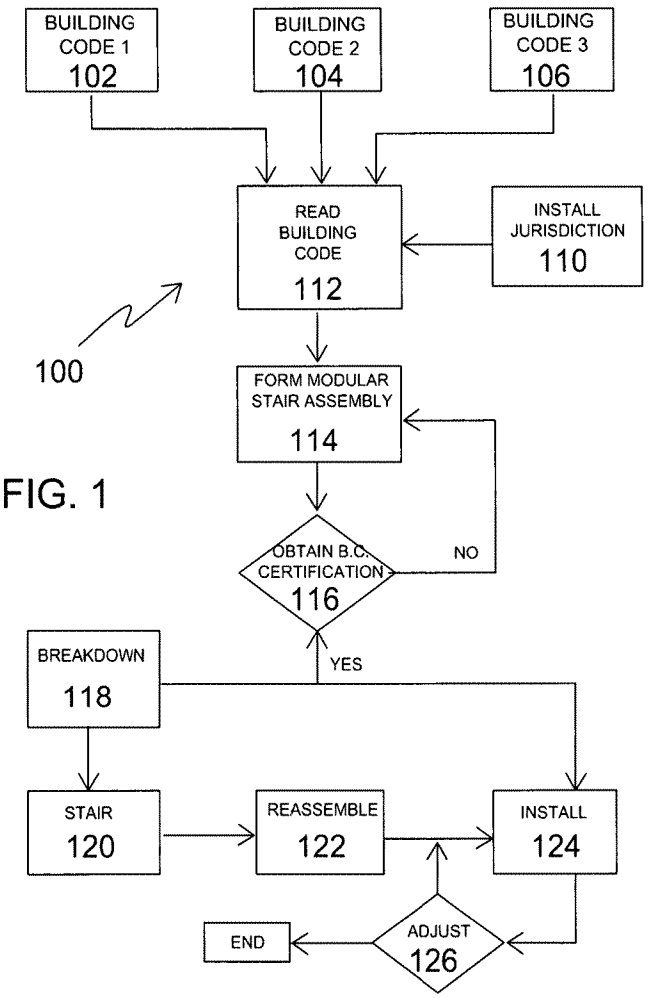
FIG. 1 is a schematic for a method for creation and installation of a stair assembly according to the preferred embodiment of the present invention.

Referring now in conjunction with FIG. 1, a method for creation and installation of a stair assembly, generally noted as 100, is shown according to the preferred embodiment of the present invention. The method 10 provides for the identification of a plurality of building code requirements from differing jurisdictions, see 102, 104 . . . 106. Upon identification of the jurisdiction where the installation will occur 110, the proper building code will be identified 112. A modular stair assembly will thereby be formed 114 in an off-site, manufacturing facility in a modularly constructed manner. The competed assembly will obtain a certificate of compliance 116 or similar certification to indicate a successful building code compliance for the identified jurisdiction. The completed stair assembly will thereby be disassembled and packages 118, as necessary, and shipped to the final building construction site 120. There, the assembly can be reassembled 122, and installed 122, including any final installation adjustments 124 needed to accommodate height, width or length adjustments needed to overcome manufacturing tolerances between the assembly and its stairwell.

Figure 2:
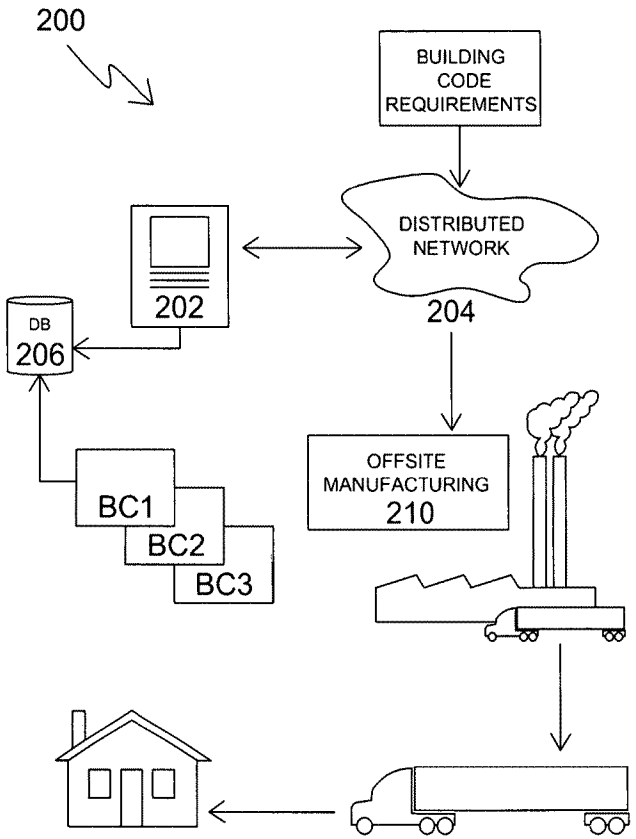
FIG. 2 is a schematic for a system for distributed manufacturing for creation and installation of a stair assembly according to the preferred embodiment of the present invention.
Figure 3:
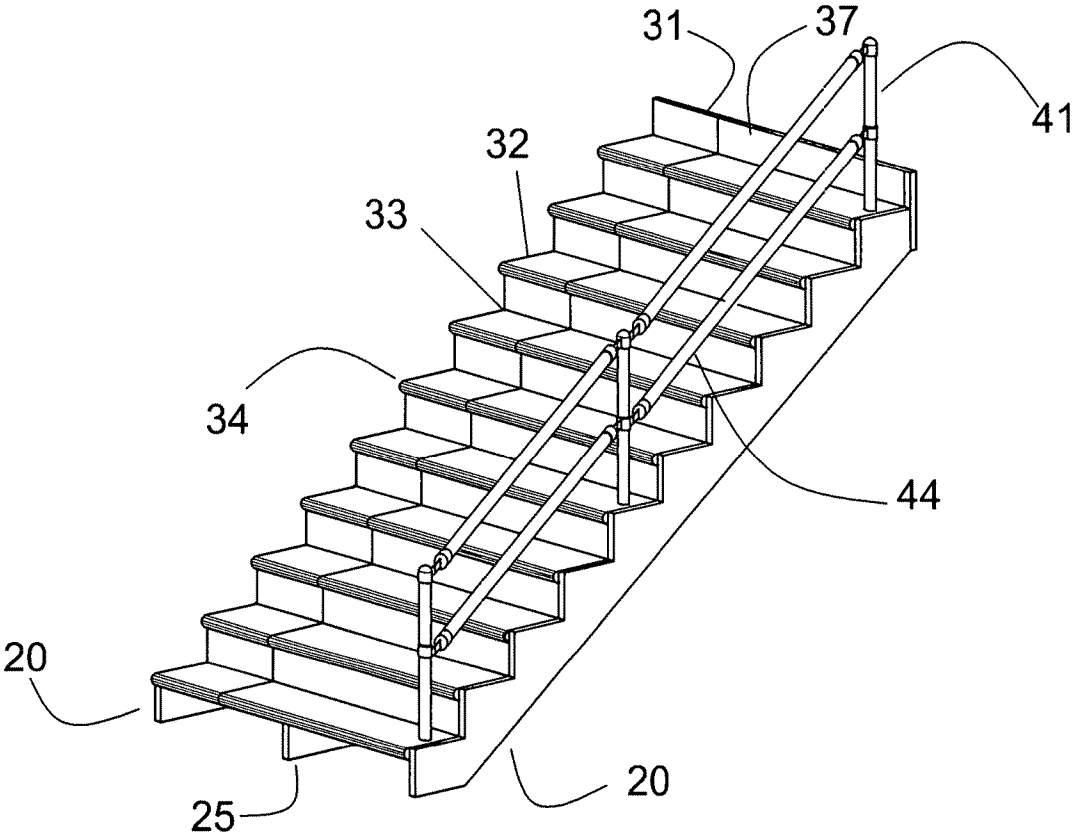
FIG. 3 is a perspective view of the stair system for use with the method and system of the present invention having a selectively expandable width.

Referring now in conjunction with FIG. 2, the method 100 may be utilized in conjunction with a distributed manufacturing system, generally noted as 200. The system 200 identifies and copies the necessary building code requirements (102, 104 . . . 106) from multiple jurisdictions to a computer server 202 over a distributed network 204. The server 202 stores the various building codes in a database 206, and can communicate a selected building code requirement for a selected staircase assembly project to an off-site manufacturing facility 210. In such a manner, different design criteria for specific stair assembly requirements for various job sites may be manufactured in an assembly-line manner in spite of potentially differing code requirements from job to job or assembly to assembly. From one or more centralized manufacturing facilities 210, individual projects may be shipped to different job sites. In such a manner, one construction site may receive a common shipment of multiple stair assemblies, where they may subsequently be installed with the confidence that each assembly has already complied with the necessary building codes of the jurisdiction. Similarly, multiple different job sites in different jurisdictions may received modular stair assemblies from the common manufacturing facility, even though each of the different job sites may have differing building code requirements.

According to the above system and method, a user may obtain building code certification for the selected jurisdiction where final permanent construction will occur. At the permanent construction site, the modular stair assembly may be formed or installed in a manner that meets both the needed design criteria and the necessary building code requirements.

In the reassembly of any modular sections of the stair assembly at a specific stair assembly location, the assembly may be placed within a specific stairwell envelope and installed by laterally extending the at least one outer stair element to comport with a final fitment before permanently securing the stair assembly.

Referring now in conjunction with FIG. 3 through FIG. 9, a stair assembly is shown typical of the modular type that may be provided with the above described systems and methods. As shown n FIG. 3, the stair assembly system is adjustable in width by being expandable at its center shown as a complete built system of its components.

Figure 4:
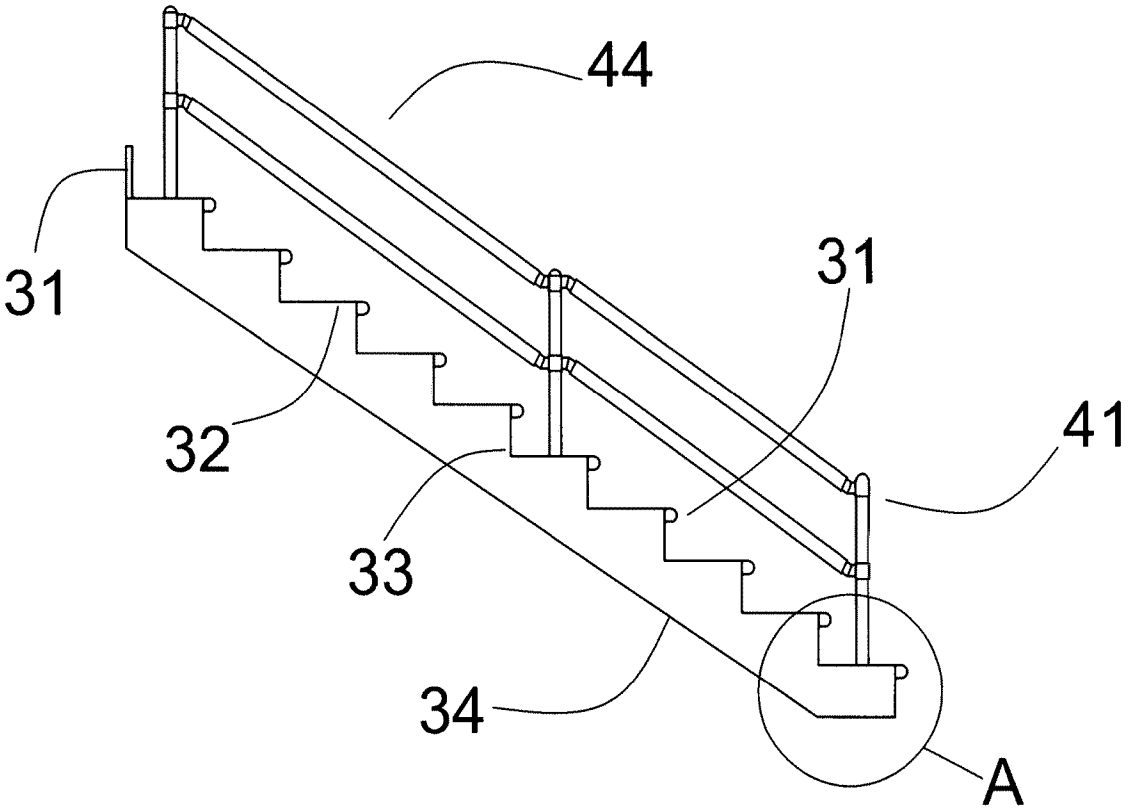
FIG. 4 is an inside or left-hand view of the stair system with expandable width with an exploded view of the bottom stair unit showing greater detail, for use with the method and system of the present invention.
Figure 4B:
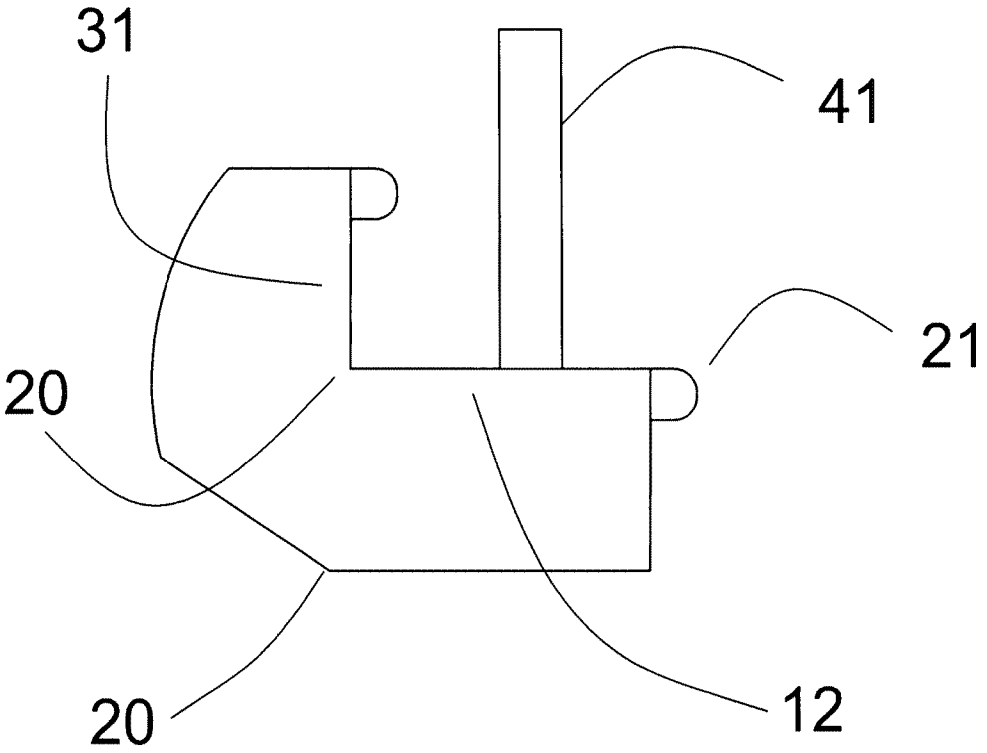

FIG. 4 shows the left-hand side view of the stair system where DETAIL A shows the configuration of the individual stair units and their relationship to each other.

Figure 5:
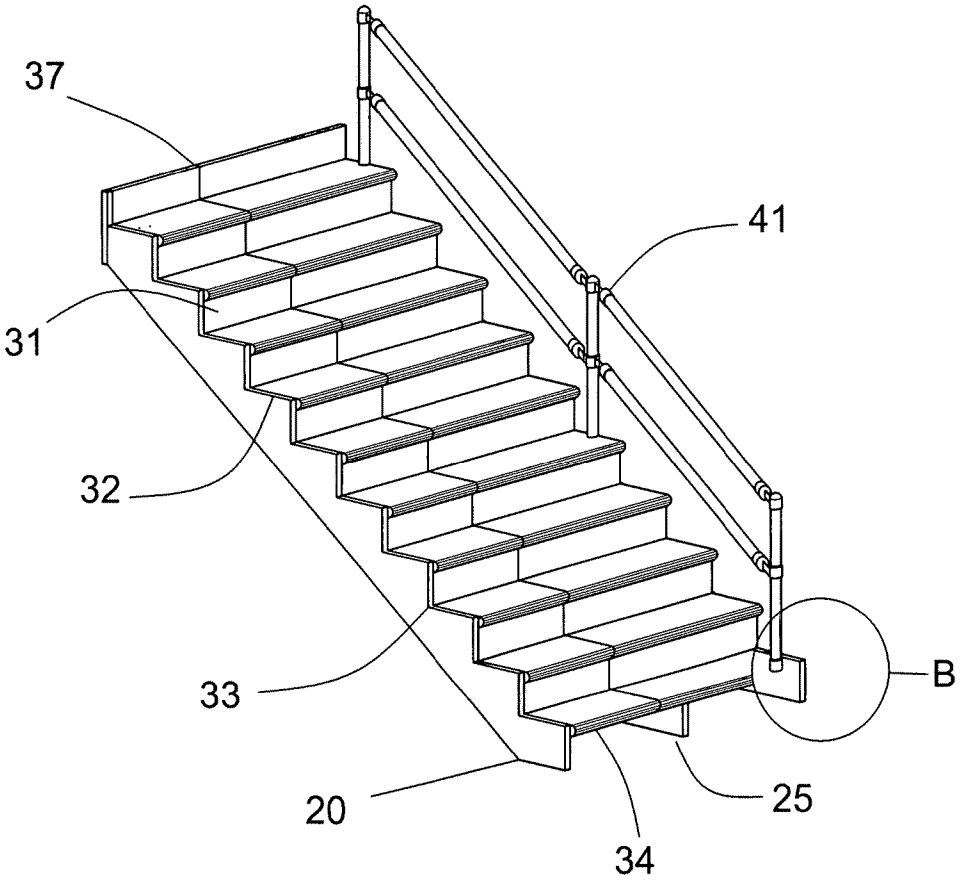
FIG. 5 is an opposing perspective view of the stair system with expandable width, with an exploded view of the bottom stair unit showing greater detail.

FIG. 5 is a front perspective view of the stair system and illustrates the sliding engagement between two individual stair units and the corner bent 33 so created. DETAIL B provides greater detail of the attachment point of the handrail system 44, specifically the handrail post 41 secured within the post receptacle 42. The handrail system 44 comprises handrail posts 41, brackets 43, and rails and is generally tubular on shape and lightweight, yet resilient in construction. The post receptacle 40 is designed to receive the handrail post 41 and is cylindrical is shape with one open end and means to lock the handrail post 41 in place. The inner diameter of the receptacle 42 is slightly larger than that of the handrail post 41 and is constructed of similar materials. A bracket 43 is affixed to the inner wall surface of the right-hand stringer 20 to retain the post receptacle 42 to said stringer 20.

Figure 6:
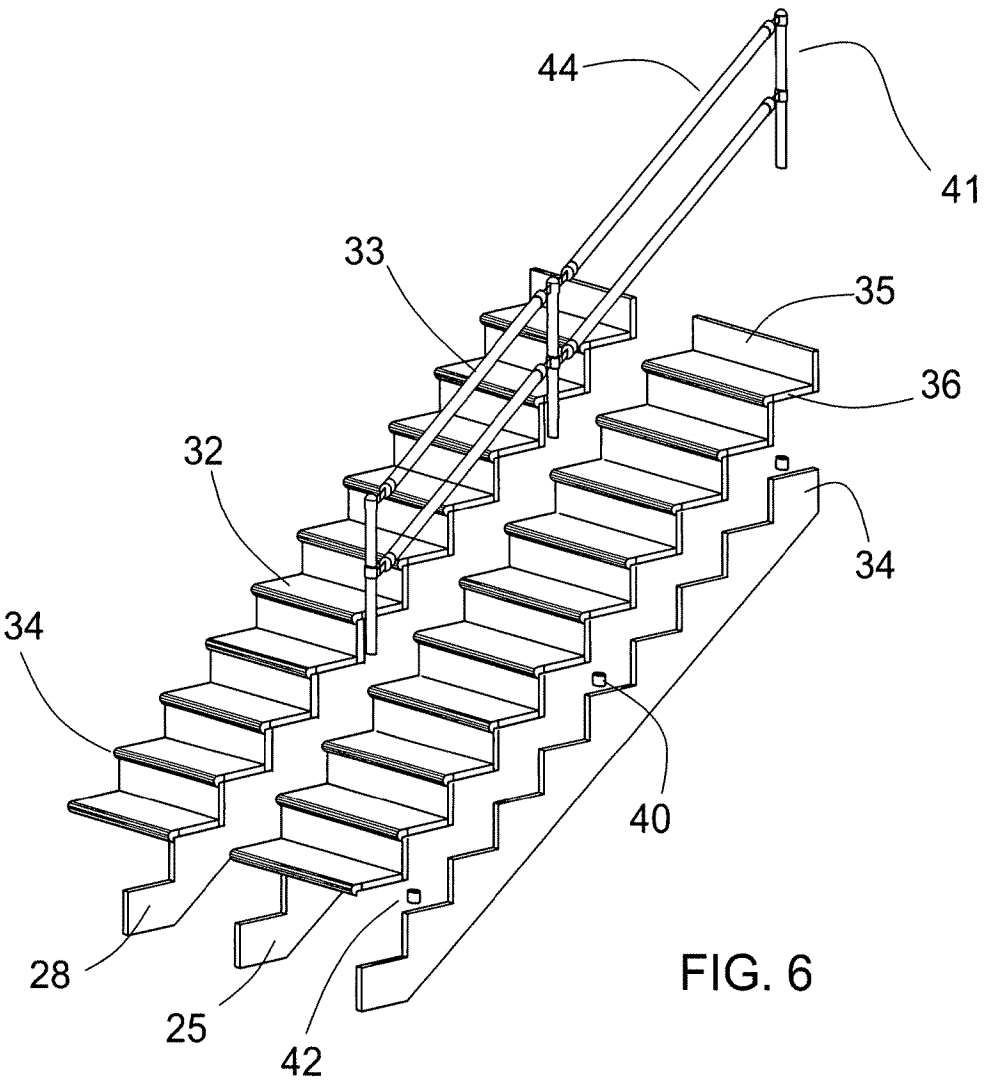
FIG. 6 is a piecemeal view of the stair system with expandable width, prior to final installation.

FIG. 6 shows the stringer boards 20, 25 that are typically a diagonal-shaped device with a series of 90° angles notched out of one side to define the length and height of the tread 32 and riser 31 portions of the stair system. The stringer boards 20, 25 should all be of equal shape and size and utilize conventional mechanical fasteners when installed to the building framework.

Figure 7:
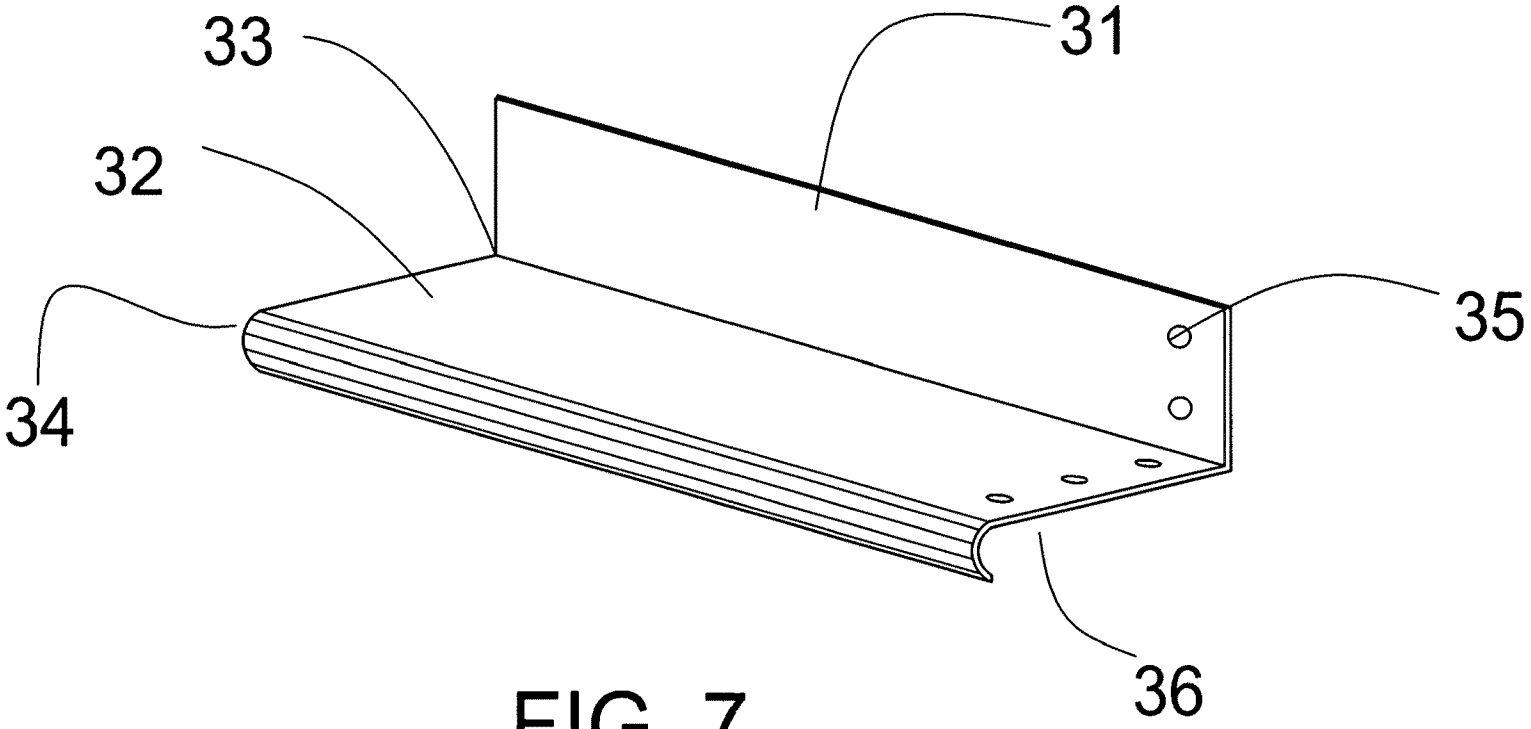
FIG. 7 is a perspective view of a stair unit.

FIG. 7 shows the stair units should all be of equal shape and size. The stair unit is bent at a 90° angle making a corner bend 33 which defines the tread 32 and riser 31 to match that of the tread and riser cut-outs on the stringers 20, 25. The leading edge of the tread 32 is formed into a lip 34, or "C"-channel which doubles back against itself to a point upon which the clearance between the lip 34 and the riser 31 portion of the stair unit installed immediately below. The lip 34, of individual stair units 34 are designed to sliding engage each other laterally, thereby defining a left- and right-hand stair unit. Both left-hand and right-hand stair units have bolts holes 35 drilled there through on the left side and right side, respectively for affixing the stair unit to its respective stringer 20. The right-hand stair units also have an aperture 36 drilled there through at the bottom, top, and every seventh or central stair unit to accommodate the handrail system 44.

Figure 8:
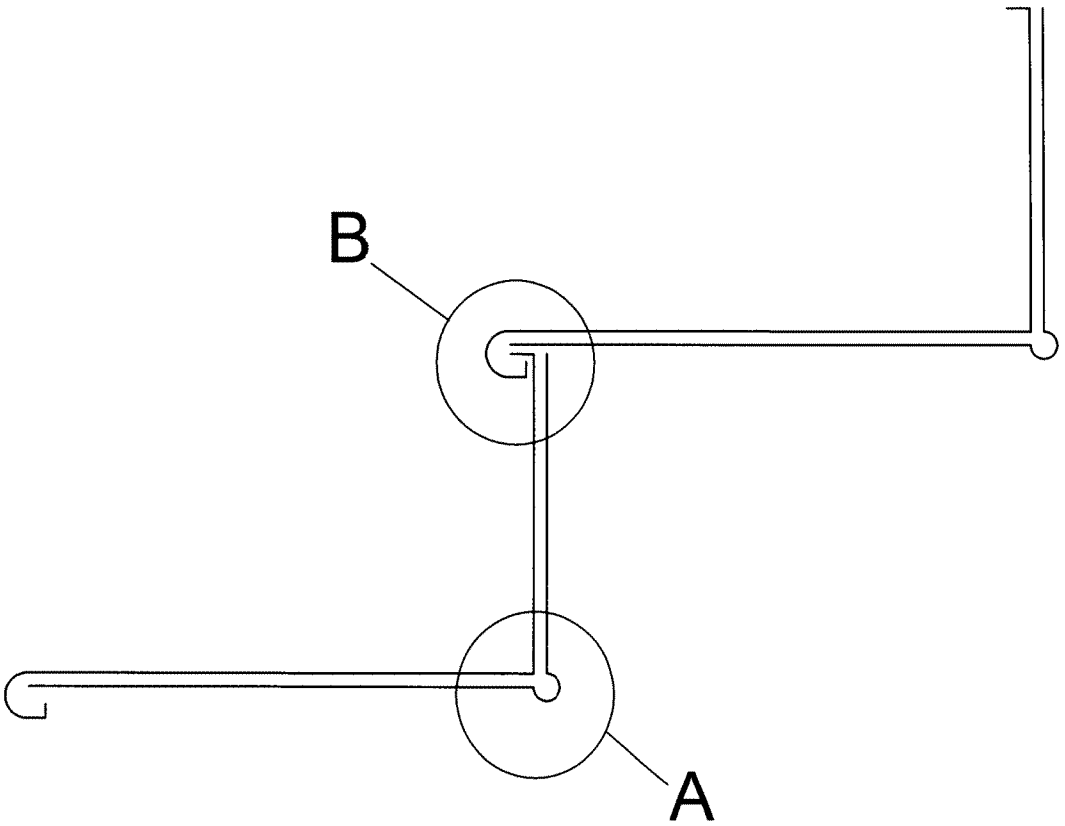
FIG. 8 is a side view of a stair and base units attached together, according to an alternate embodiment of the present invention.
Figure 8B:
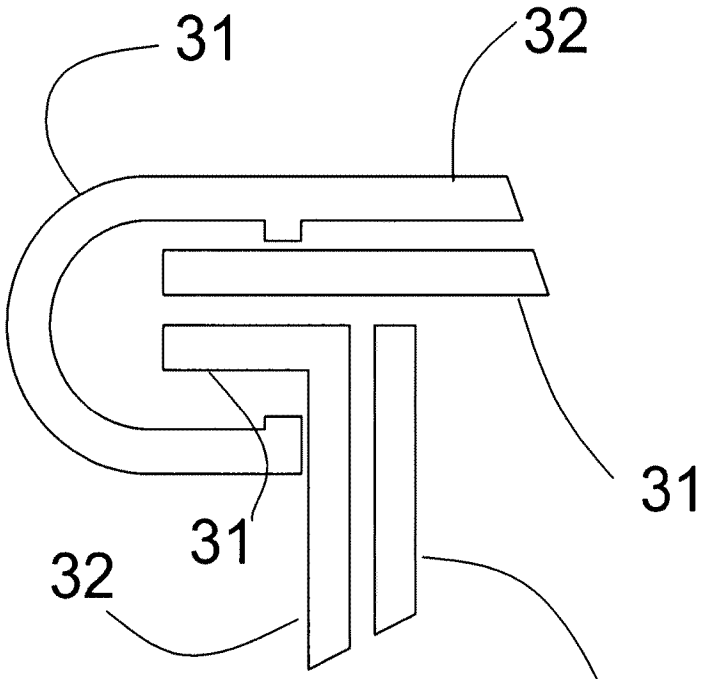
Figure 8A:
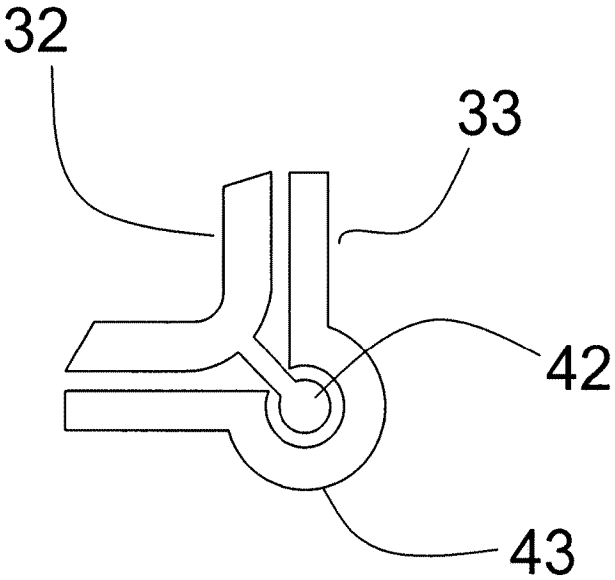

FIG. 8 illustrates an alternate embodiment of the stair system. The stair assemblies here include two separate units, riser 31 and a tread 32, a retaining clip to connect two stair units together, and a sliding assist piece. DETAILS A and DETAILS B show the bends and configuration for the riser and stringer, as well as the shapes of the second projecting structure 50 and lip 34. The material of construction for the base and stair unit may be the same as is shown in FIG. 7 and the retaining clip and sliding assist piece for vibration dampening and minimal friction may be an ultra-high molecular weight (UHMW) polyethylene or other material with the same properties. DETAILS A and B show the bends and configuration for the stair and base units, as well as the shapes of the retaining clip and sliding assist piece.

2. Operation of the Preferred Embodiment

The preferred embodiment of the present invention is designed to be used by a normal person with some skills and minimal training necessary.

Figure 9:
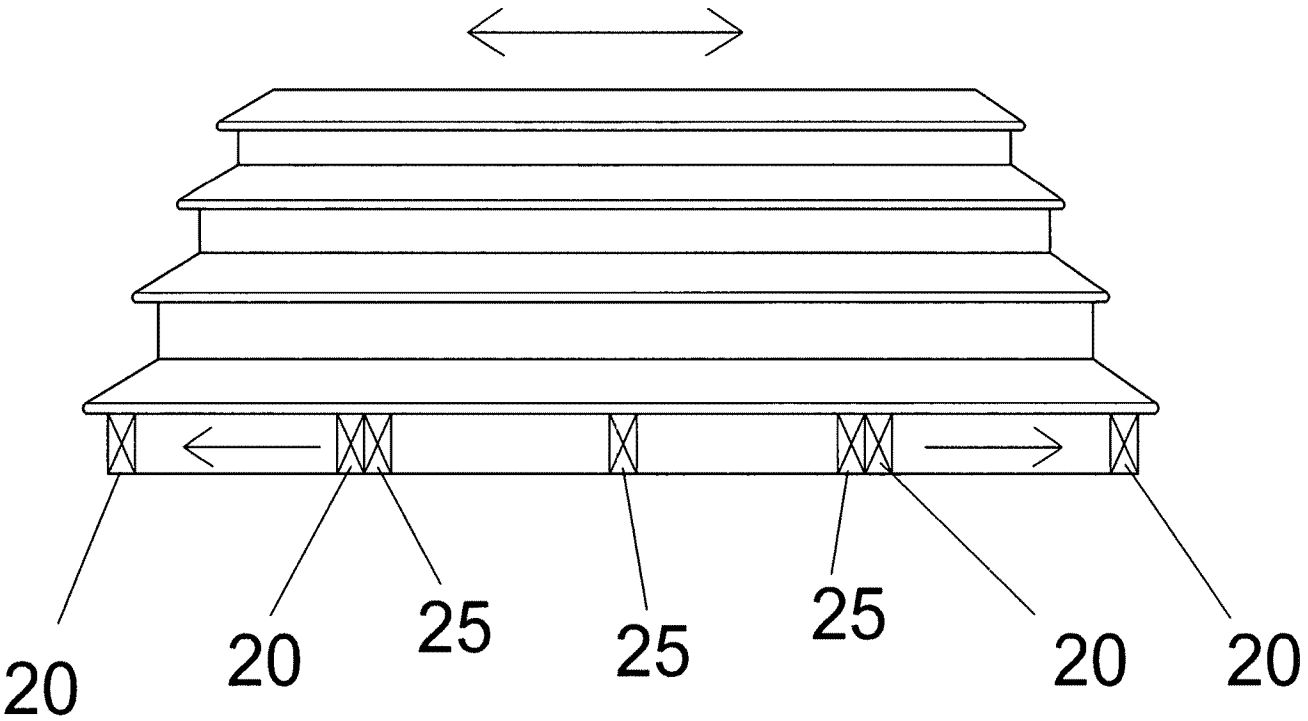
FIG. 9 is a front schematic view according to a second alternate embodiment of the present invention that depicts an exemplary selectively adjustable width.

As exemplified in conjunction with FIG. 9, the stair system with a laterally expandable width 10 is designed for the fabricator or building contractor in mind. Custom building flights of stairs can take a lot of time that could be used to complete other tasks. Therefore, a reliable and easily constructed modular stair system that can fit any situation such as is presently defined can become a great time and resource saver.

The present invention is designed such that significant stair assembly elements may be prefabricated off-site according to the general specifications of the construction and transported to the site for final fitting and finishing in the space provided. The first step is measuring the total height and width by laying out the rise and run of the stringers 20, 25 that will be cut. The height is determined by the measured distance between the finished bottom floor to the top of the upper deck and the width is generally determined by standard building codes. Two (2) outside stringers 20 and a third central stringer 25 are identically cut to form the support structure of the stair units 30. The outside stringers 20 are intended to be laterally adjustable to allow to be subsequently field-fixed at each lateral end once the final stair width is determined. One or more central stringers 25 are intended to be fixed at to support a centerpoint(s) the stairs as the left and right half of the units are positioned to a selected width.

The next step required is to form the tread 32 and riser 31 from the sheet stock of the stair unit 30 to the required shape. A 90° angle is needed to define the boundary 33 of the tread 32 to the riser 31. On the opposite end of the tread 32 from the bend 33, a lip 34 is formed by rolling the leading edge about a radius and doubling back against itself creating a "C"-shaped channel, through which another stair unit 30 similarly formed can slide there through. The backwards bend of the lip 34 should result in minimal clearance between the lip 34 and the front-facing surface of the top of the riser section 31 of the bottom stair unit 30. Apertures or slots 35 are then formed at spaced intervals near the same edge of the tread 32 and riser 31 to accommodate nails or bolts. Care must be taken here to form identical stair units 30. Half of the stair units 30 should have the formed bolt holes 35 on its right side (see FIG. 5) and the other stair units' bolt holes 35 formed on the left side. Also, the handrail pole aperture 36 is cut out on a desired side of the tread 32 of every seventh stair unit 30 as per OSHA guidelines (see FIG. 5), and ensuring that the bottom, top, and at least one central stair unit 30 are included.

At this point, the finished stair units 30 should be secured to the top and front surface of the stringers 20, 25. Handrail pole receptacles 42 are mounted on brackets 43 are to be installed on the inside surface of the stringer 20 at locations corresponding to the bottom step, top step, and seventh or central step at a position below the projected placement of the stair unit 30 (see FIG. 3, Detail B). Edge and pressure blocking may at this time be attached at the top and bottom of each stringer 20 for use during final installation. The pre-fabrication of the stair system with expandable center 10 is now ready for transport to the job-site, along with the central stringer 25 and handrail system 44.

When the pre-fabricated stair system 10 has been delivered to the job site and placed in the space provided, final installation of the device 10 should commence (see FIG. 6). The right and left sides of the system 10 are adjoined together by overlapping the "C"-channels 34 of the treads 32 of one side overtop the other side, providing a sliding engagement between the two (2) sides. It is important at this stage to ensure that the side with the temporary handrail pole apertures 36 are on the outside edge as opposed to abutment of the stair system 10 against a wall. One side of the stair system 10 should be secured to the building framework with the other side manipulated into place by sliding the entire side until it abuts the framework on the opposite side, at which point it is secured thereto. The central stringer 25 is then positioned laterally to be placed at and secured to a central point underneath the stair system 10 by bolts, screws, or nails driven through the tread 32 and riser 31 portions of the overlapping stair units 30, preferably in the same pattern as used to secure the separate stair units 30 to their respective stringer 20. Any height adjustment is inherently minimal due to building code regulations on riser 31 height and are accounted for by the overlap and bend of the lip 34 formed at the leading edge of the tread 32 portion ("C"-channel) during prefabrication.

The handrail system 44 is then installed where needed by feeding the poles 41 through the apertures 36 located on the tread 32 and secured within the receptacle 42 mounted to the inside of the stringer 20 via a bracket 43 by a channel lock or similar system. A similar securing system is present for installing the handrails to the pole 41. Both the handrails and poles 41 may be expandable as necessary. This handrail system 44 is necessary due to OSHA requirements and may be easily removed and the apertures 56 covered with a cap or plug when the handrail system 44 is not installed.

Additional finishing for the handrail system 10 is generally left up to the building fabricator or stair constructor but typically involves the use of an adhesive or coating to protect the stair system 10 and to cover, protect, and level the lap seam 37 formed during final installation. It is conceived that an adhesive tape will be applied to the lap seam 37 to affect a smooth transition for carpet applications. Edge and pressure blocking for final construction may be attached during pre-fabrication or during final installation.

It is conceivable that other alternate embodiments for the present invention may provide additional support and ease of construction. A "T"-channel piece designed for attachment directly to the top surface of each stringer step, with the extended piece fitting within a similarly shaped and sized notch formed downward from the top surface of said stringer step, provides added support for the stair units.

A more elaborate design involving a separate tread and riser stair unit and base unit with more bends are referred to in FIG. 6. The sliding point in particular has a separate rounded extension piece offset from the corner bend defining the riser and tread boundary and running the entire width of said boundary. This rounded piece is received within a similarly yet opposite shaped groove on the base unit. The base unit is placed first on top of the top and front facing stringer surfaces and the tread and riser stair unit is placed on top of the base unit, with the vertically interlocking pieces corresponding to specialized bends at the leading edge of the tread portion. Vibration dampening devices such as UHMW polyethylene fill in the space and secure said stair units and base units together at the lip joint and at the sliding point to provide a smoother movement between the lateral stair units.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp*. v. *Shoketsu Kinzoku Kogyo Kabushiki Co.,* 535 U.S. 722 (2002), or other similar caselaw or subsequent precedent should not be made if any future claims are added or amended subsequent to this Patent Application.

What is claimed is:

1. A method for the off-site modular manufacture of staircase assemblies for installation at a remote construction site comprising the steps:

a. obtaining design criteria for at least one stair assembly;

b. obtaining building code requirements for at least one selected jurisdiction where a final permanent construction will occur;

c. form a modular stair assembly that meets both the design criteria and the building code requirements;

d. obtain a building code certification of the modular stair assembly;

e. disassemble the modular stair assembly and package said disassembled modular stair assembly in sections optimized for either shipping costs or reassembly efficiency;

f. ship said packages of said disassembled modular stair assembly to the at least one selected jurisdiction;

g. reassemble the disassembled modular stair assembly at a specific stair assembly location by placing the at least one modular stair assembly within a stairwell envelope; and h. laterally extending the at least one outer stair element to comport with a final fitment before permanently securing the stair assembly.

2. The method for the off-site modular manufacture of staircase assemblies for installation at a remote construction site of claim 1, wherein said modular stair assembly is characterized in having fixed center support stringers and at least one outer stair element that may be laterally adjustable in a manner that does not violate the building code of the selected jurisdiction.

3. The method for the off-site modular manufacture of staircase assemblies for installation at a remote construction site of claim 2, wherein said modular stair assembly further comprises:

a left stringer and a right stringer, each said stringer having a diagonally shaped series of equally spaced substantially vertical and horizontal structures notched out of one side to define a length and a height of each step of a stair system;

at least one central stringer positionable between said left stringer and right stringer, said at least one central stringer also having a similar diagonally shaped series of equally spaced substantially vertical and horizontal structures notched out of one side to define a length and a height of each step of a stair system;

a plurality of stair units, each of said plurality of stair units further comprising:

a left stair unit;

a right stair unit slidably engaging in a telescoping manner with said left stair unit such as to create a variable and expandable width;

wherein each said left unit and said right unit further comprise:

a substantially vertically oriented riser;

a substantially horizontally oriented tread perpendicularly connected to a lower end of said substantially vertically oriented riser at a corner bend;

wherein each said substantially vertically oriented riser aligns with and affixes to one of said series of equally spaced substantially vertical structures notched out of said stringers and each substantially horizontally oriented tread aligns with and affixes to one of said series of equally spaced substantially horizontal structures notched out of said stringers, whereby the plurality of stair units and the left stringer, right stringer and a least one central stringer together comprising a complete stair assembly can be adjusted laterally via lateral sliding between the plurality of stair units.

4. A distributed manufacturing system for practicing the method for the off-site modular manufacture of staircase assemblies for installation at a remote construction site of claim 1, the system comprising:

a database including design criteria for at least one stair assembly and the building code requirements for at least one selected jurisdiction where a final permanent construction will occur;

a computer server in communication with said database and communicating over a distributed network to an off-site manufacturing facility;

a modular stair manufacturing facility adapted for manufacturing the obtaining design criteria for at least one stair assembly in a manner that meets both the needed design criteria and the necessary building code requirements; and at least one permanent construction site where the modular stair assembly is installed.

5. The distributed manufacturing system of claim 4, further comprising a final reassembly system for the reassembly of any modular sections of the stair assembly at a specific stair assembly location and within a specific stairwell envelope.

6. A distributed manufacturing system for practicing the method for the off-site modular manufacture of staircase assemblies for installation at a remote construction site of claim 2, the system comprising:

a database including design criteria for at least one stair assembly and the building code requirements for at least one selected jurisdiction where a final permanent construction will occur;

a computer server in communication with said database and communicating over a distributed network to an off-site manufacturing facility;

a modular stair manufacturing facility adapted for manufacturing the obtaining design criteria for at least one stair assembly in a manner that meets both the needed design criteria and the necessary building code requirements; and at least one permanent construction site where the modular stair assembly is installed.

7. The distributed manufacturing system of claim 6, further comprising a final reassembly system for the reassembly of any modular sections of the stair assembly at a specific stair assembly location and within a specific stairwell envelope.

8. A distributed manufacturing system for practicing the method for the off-site modular manufacture of staircase assemblies for installation at a remote construction site of claim 3, the system comprising:

a database including design criteria for at least one stair assembly and the building code requirements for at least one selected jurisdiction where a final permanent construction will occur;

a computer server in communication with said database and communicating over a distributed network to an off-site manufacturing facility;

a modular stair manufacturing facility adapted for manufacturing the obtaining design criteria for at least one stair assembly in a manner that meets both the needed design criteria and the necessary building code requirements; and at least one permanent construction site where the modular stair assembly is installed.

9. The distributed manufacturing system of claim 8, further comprising a final reassembly system for the reassembly of any modular sections of the stair assembly at a specific stair assembly location and within a specific stairwell envelope.

* * * * *